United States Patent [19]

Yoshitake et al.

[11] Patent Number: 4,964,924

[45] Date of Patent: Oct. 23, 1990

[54] SUCTION ROLL MADE OF A MARTENSITIC STAINLESS STEEL

[75] Inventors: Akira Yoshitake; Motoki Sakashita, both of Hirakata, Japan

[73] Assignee: Kubota Corporation, Osaka, Japan

[21] Appl. No.: 361,179

[22] Filed: Jun. 5, 1989

[51] Int. Cl.[5] ..... C22C 38/42; C22C 38/44

[52] U.S. Cl. ..... 148/325; 420/61

[58] Field of Search ..... 420/61; 148/325

[56] References Cited

FOREIGN PATENT DOCUMENTS 60-121259 6/1985 Japan ..... 420/61

378505 4/1973 U.S.S.R. ..... 420/61

813801 5/1959 United Kingdom ..... 420/61

*Primary Examiner*—Deborah Yee

*Attorney, Agent, or Firm*—Armstrong, Nikaido, Marmelstein, Kubovcik & Murray

[57] ABSTRACT

A martensitic stainless steel having high corrosion fatigue strength and excellent corrosion resistance and consisting essentially of over 0 to not greater than 0.06% of C, over 0 to not greater than 2.0% of Si, over 0 to not greater than 2.0% of Mn, 3.0 to 6.0% of Ni, 14 to 17% of Cr, 1 to 3% of Mo, 0.5 to 1.5% of Cu, and the balance Fe and inevitable impurities, as expressed in % by weight.

1 Claim, No Drawings

SUCTION ROLL MADE OF A MARTENSITIC STAINLESS STEEL

FIELD OF THE INVENTION

The present invention relates to improvements in martensitic stainless steels, and more particularly to martensitic stainless steel suited as a material for uses wherein high corrosion fatigue strength and high corrosion resistance are required, for example, for paper-making suction rolls, seawater pumps and various other chemical apparatus.

BACKGROUND OF THE INVENTION

For example, suction sleeve rolls in the paper-making industry are used as exposed to white water and must therefore have high corrosion resistance and high corrosion fatigue strength. The materials which are outstanding in these characteristics include ferrite-austenite duplex stainless steel, precipitation-hardened stainless steel and the like, but these materials are generally poor in cuttability. Since these materials are especially poor in machinability with drills, they are extremely difficult to cut with twist drills and are actually not usable.

Accordingly, martensitic stainless steels, typical of which is JIS SCSl material, are widely used for paper-making suction rolls because these steels are excellent in machinability with drills and inexpensive. Nevertheless, these materials have the problem of being low in stability when used for machine members. For example, they are not fully satisfactory in corrosion resistance and fatigue strength for use in corrosive environments containing chlorine ion. Especially when used under conditions involving repeated stresses, the material deteriorates early, permitting failures such as a break of rolls.

In the case of paper mills, in particular, the operation is conducted in recent years at a higher speed, at a lower pH value and at a higher concentration of $S_2O_3^{2-}$ ions and is therefore carried out in a more corrosive environment due to the presence of white water. Thus, it is required that the material to be used be improved in corrosion resistance and corrosion fatigue strength.

The present invention provides a novel material fulfilling this requirement.

SUMMARY OF THE INVENTION

The main object of the present invention is to provide a martensitic stainless steel consisting essentially of over 0 to not greater than 0.06% of C, over 0 to not greater than 2.0% of Si, over 0 to not greater than 2.0% of Mn, 3.0 to 6.0% of Ni, 14 to 17% of Cr, 1 to 3% of Mo, 0.5 to 1.5% of Cu, and the balance Fe and inevitable impurities, as expressed in % by weight.

The martensitic stainless steel of the present invention has high corrosion fatigue strength and excellent corrosion resistance and is suited especially as a material for paper-making suction rolls, chemical apparatus, pump components and seawater handling devices which are used in corrosive environments involving the presence of chlorine ion.

DETAILED DESCRIPTION OF THE INVENTION

The contents of components of the present stainless steel are limited as above for the following reasons.

C: over 0 to not greater than 0.06%

C is an austenite forming element and is in a solid solution in the austenitic phase to reinforce the structure. However, when present in an increased amount, C forms Cr carbide and consumes Cr which is effective for giving improved corrosion resistance to thereby reduce the corrosion resistance. Further a large amount of Cr carbide, if separating out, results in impaired toughness. Accordingly, the upper limit of C should be 0.06%.

Si: over 0 to not greater than 2.0%

Si serves as a deoxidizer when the steel is melted. When present in a large amount, however, Si embrittles and otherwise impairs the material characteristics, so that the upper limit is 2.0%.

Mn: over 0 to not greater than 2.0%

Mn acts also as a deoxidizer like Si and serves to fix sulfur (S) when the steel is melted. However, a large amount of Mn, when present, entails lower corrosion resistance, hence the upper limit of 2.0%.

Ni: 3.0 to 6.0%

Ni is an austenite forming element, forms a residual austenitic phase in microstructures and is effective for giving improved toughness and corrosion resistance. Paper-making suction sleeve rolls are generally large rolls exceeding 1 m in diameter and 100 mm in wall thickness as cast, and are usually produced by centrifugal casting. When the conventional SCSl material was used for casting such rolls, the casting process encountered various problems such as cracking during casting. The presence of Ni affords improved castability. Furthermore, a proper amount of Ni, when present, serves to form a proper amount of residual austenitic phase, which in turn ensures enhanced toughness and renders the steel solidifiable in an improved mode. To assure these advantages, at least 3.0% of Ni needs to be present, whereas presence of a larger amount of Ni forms an excessive amount of residual austenite, hence an objectionable result. An increased cost will then result since Ni is an expensive element. Accordingly, the Ni content should be up to 6.0%.

Cr: 14 to 17%

Cr, which is a ferrite forming element, is an essential element for imparting enhanced strength by forming a ferrite phase and giving corrosion resistance to the stainless steel. The Cr content must be at least 14% to assure high strength and high corrosion resistance. However, presence of a large amount of Cr forms an increased amount of ferrite phase in the microstructure to result in impaired corrosion resistance and toughness. Accordingly, the upper limit should be 17%. Incidentally, the Cr content is closely related to the contents of C and Ni as austenite forming elements and the content of Mo as a ferrite forming element. In view cf this, it is suitable to limit the Cr content to the range of 14 to 17% according to the invention.

Mo: 1 to 3%

Mo is very effective for affording improved resistance to corrosion, especially to pitting. If the Mo content is less than 1%, the effect is insufficient, whereas presence of more than 3% of Mo results in lower toughness and an increased cost. The upper limit should therefore be 3%.

Cu: 0.5 to 1.5%

Cu affords increased resistance to general corrosion and is effective for giving a reinforced austenitic solid solution. Especially, a further enhanced effect to inhibit general corrosion can be produced synergistically by Cu and Mo (as will be made apparent from the example to follow). The stainless steel of the present invention has a great significance in that the steel contains various components in good balance and further contains Cu and Mo which produce a synergistic effect to give remarkably increased resistance to general corrosion. To fully ensure this effect, at least 0.5% of Cu should be present. On the other hand, too high a Cu content results in lower toughness, so that the upper limit should be 1.5%.

The stainless steel of the present invention contains the foregoing component elements, the balance being Fe, and impurity elements which become inevitably incorporated into the steel. These impurities include P, S and others which become inevitably incorporated into the steel when it is prepared by melting. Such impurities may be present insofar as the impurity content is within a range which is usually allowable for steels of the type mentioned.

An example is given below to specifically describe the improvements achieved by the martensitic stainless steel of the invention in corrosion resistance and corrosion fatigue strength.

EXAMPLE

Alloys of various compositions were prepared using a high-frequency induction furnace and cast into ingots by centrifugal casting. Table 1 shows the chemical compositions of test specimens prepared from the ingots.

The specimens were heat-treated (cooling in air at 1050° C., tempering at 650° C.) and subjected to a general corrosion test and corrosion fatigue strength test. Table 2 shows the results. The tests were conducted by the following methods.

For the general corrosion test, the specimen was immersed in 5% boiling sulfuric acid for 6 hours and checked every hour for the corrosion loss per $m^2$.

The corrosion fatigue strength test was conducted in a liquid having a pH of 3.5 and containing 100 ppm of $Cl^-$ and 1000 ppm of $SO_4^{2-}$ using Ono's rotating bending fatigue tester at a rotational speed of 3000 r.p.m. under a load stress of 18 kg/$mm^2$. The number of repeated cycles required for fracturing the specimen was determined.

TABLE 1

| Specimen No. | Chemical composition (wt. %)* | | | | | | |
|---|---|---|---|---|---|---|---|
| | C | Si | Mn | Cr | Ni | Mo | Cu |
| 1 | 0.05 | 0.37 | 0.68 | 11.77 | 0.48 | 0.02 | — |
| 2 | 0.05 | 0.52 | 0.80 | 11.95 | 0.53 | 0.58 | — |
| 3 | 0.05 | 0.41 | 0.72 | 16.00 | 6.13 | 2.03 | — |
| 4 | 0.05 | 0.42 | 0.81 | 16.12 | 5.01 | 2.11 | 1.01 |

*The balance Fe and inevitable impurities.

TABLE 2

| Specimen No. | Corrosion loss ($g/m^2.h$) | Corrosion fatigue strength (number of cycles) |
|---|---|---|
| 1 | 1060 | $1.1 \times 10^7$ |
| 2 | 780 | $1.2 \times 10^7$ |
| 3 | 520 | $3.0 \times 10^7$ |
| 4 | 50 | $9.1 \times 10^7$ |

With reference to Table 1, Specimen No. 1 is the conventional JIS SCSl material, Specimens No. 2 and No. 3 are comparative materials prepared for comparison with the stainless steel of the invention, and Specimen No. 4 is the stainless steel of the invention.

The results of Table 2 reveal that the stainless steel of the invention is much smaller in corrosion loss than the conventional material and the comparative materials and has excellent resistance to general corrosion.

In respect of the fatigue strength determined under the corrosive environment, the stainless steel of the invention has about seven times the strength of Specimens No. 1 and No. 2 and about three times the strength of Specimen No. 3.

These excellent characteristics are believed to be attributable to the synergistic effect of Mo and Cu.

The stainless steel of the present invention is outstanding in corrosion resistance and corrosion fatigue strength and is therefore well-suited as a material for paper-making rolls, chemical apparatus, pump components, seawater handling devices and the like of which such characteristics are required.

What is claimed is:

1. A suction roll adapted for use in a paper-making process and made of a martensitic stainless steel having high corrosion fatigue strength and high corrosion resistance, said steel consisting of, by weight, over 0 to not greater than 0.06% of C, over 0 to not greater than 2.0% of Si, over 0 to not greater than 2.0% of Mn, 3.0 to 6.0% of Ni, about 16 to 17% of Cr, 1 to 3% of Mo, 0.5 to 1.5% of Cu, and the balance Fe and inevitable impurities.

* * * * *